United States Patent [19]

Zinn et al.

[11] Patent Number: 5,064,973

[45] Date of Patent: Nov. 12, 1991

[54] ELECTRICAL SWITCHING ARRANGEMENT

[75] Inventors: Bernd Zinn, Ennepetal; Werner Reuter, Erkrath, both of Fed. Rep. of Germany

[73] Assignee: Grote & Hartmann GmbH & Co. KG, Wuppertal, Fed. Rep. of Germany

[21] Appl. No.: 427,872

[22] Filed: Oct. 30, 1989

[30] Foreign Application Priority Data

Nov. 4, 1988 [DE] Fed. Rep. of Germany ... 8813826[U]
Feb. 10, 1989 [DE] Fed. Rep. of Germany ... 8901560[U]

[51] Int. Cl.[5] ..... H01R 33/96; H01R 13/703
[52] U.S. Cl. ..... 200/51.1; 439/188
[58] Field of Search ..... 200/51.09, 51.1; 439/188

[56] References Cited

U.S. PATENT DOCUMENTS 4,070,557 1/1978 Ostapovitch ..... 200/51.1
4,978,311 12/1990 Oda et al. ..... 439/188

FOREIGN PATENT DOCUMENTS 1811276 6/1970 Fed. Rep. of Germany .
2415486 10/1974 Fed. Rep. of Germany .
2338778 2/1975 Fed. Rep. of Germany .
2555138 6/1977 Fed. Rep. of Germany .
3028895 2/1982 Fed. Rep. of Germany .
3300519 7/1984 Fed. Rep. of Germany .
8525476 11/1985 Fed. Rep. of Germany .
3428638 1/1986 Fed. Rep. of Germany .
3633358 4/1988 Fed. Rep. of Germany .
2025711 1/1980 United Kingdom .

*Primary Examiner*—J. R. Scott
*Attorney, Agent, or Firm*—Goodman & Teitelbaum

[57] ABSTRACT

An electrical switching arrangement for an electric contacting system of an airbag having a short circuit bridge arrangement in a plug, which includes a counter-contact casing and a contact sleeve casing of plastic. In the two casings, there are provided chambers in which are seated connectors connected to electric lines. The casings of the plug are hinged with one another, and a short circuit bridge is provided, in each case, between adjacent contacts in such a way that on opening of the plug, the adjacent contacts are short-circuited first before the connectors of the plug are separated. The contact sleeve casing is constructed substantially in slab form and includes a surrounding casing and an inner casing. The inner casing includes side walls and two front walls, as well as a cover wall and a bottom wall.

37 Claims, 4 Drawing Sheets

ELECTRICAL SWITCHING ARRANGEMENT

BACKGROUND OF THE INVENTION

The invention relates to an electrical switching arrangement for the electric initiation of an airbag.

Airbags are located, for example, in the steering wheel or rear of a motor vehicle. In an impact accident the airbag is to be very rapidly unfolded and inflated For the initiation of these mechanical processes there is provided an electric switching system which reacts to certain commands.

It is necessary from time to time—for example for maintenance purposes—to test the switching system without triggering the functioning of the airbag. With the known switching system this is extremely difficult.

The problem of the invention is to create a simply constructed electric switching arrangement for the electrical switching system of an airbag.

This problem is solved by the features of the present invention, as set forth below, where advantageous further developments of the invention are characterized below.

The switching system includes a plug which consists of a counter-contact—for example a contact pin—and a contact sleeve casing of plastic. Especially in the contact sleeve casing there are introduced chambers in which there are inserted electric connectors formed of sheet metal stamped parts, having contact spring arms crimped to electric lines.

With the aid of the drawing the invention is explained in the following by way of example.

DETAILED DESCRIPTION

Figure 1:
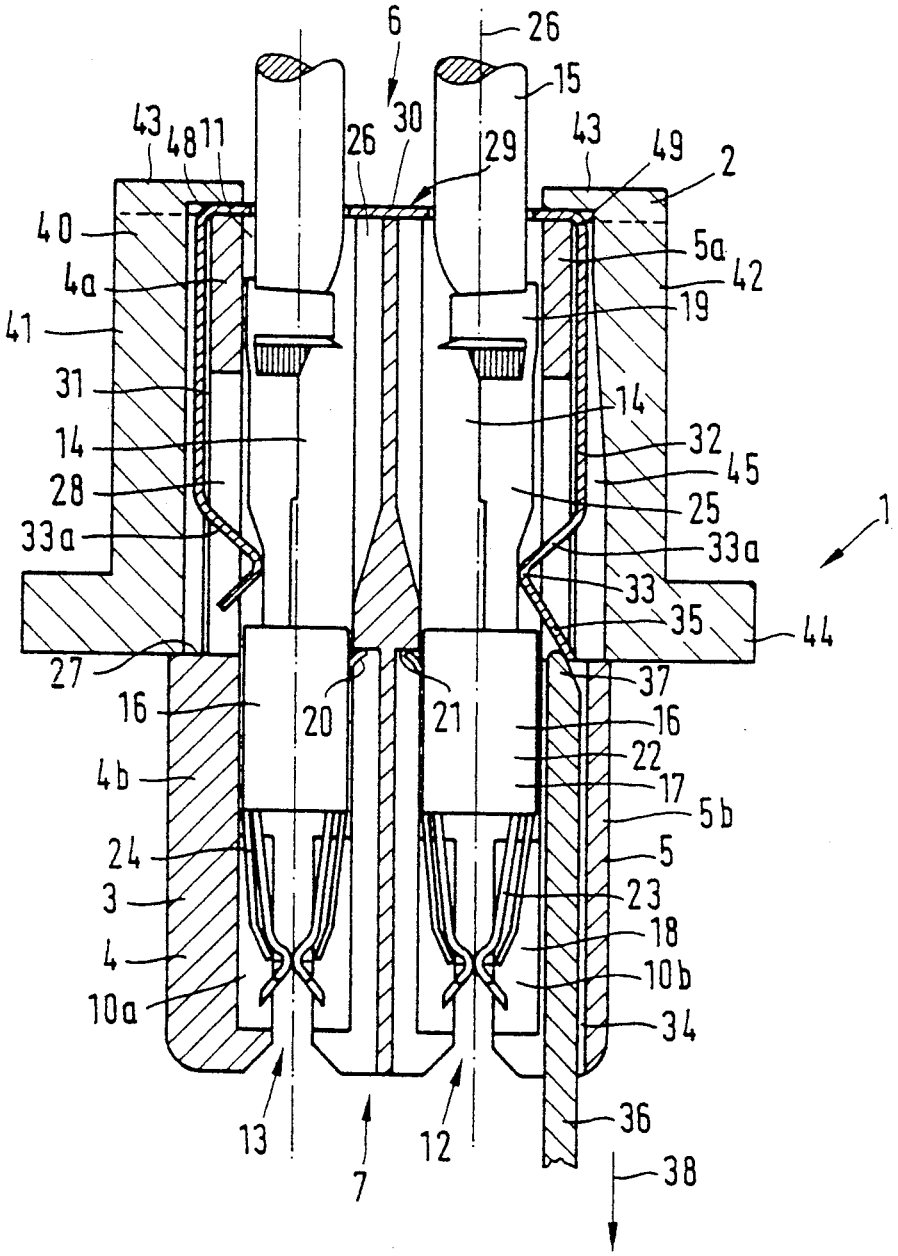
FIG. 1 shows a cross section through a contact sleeve casing.
Figure 2:
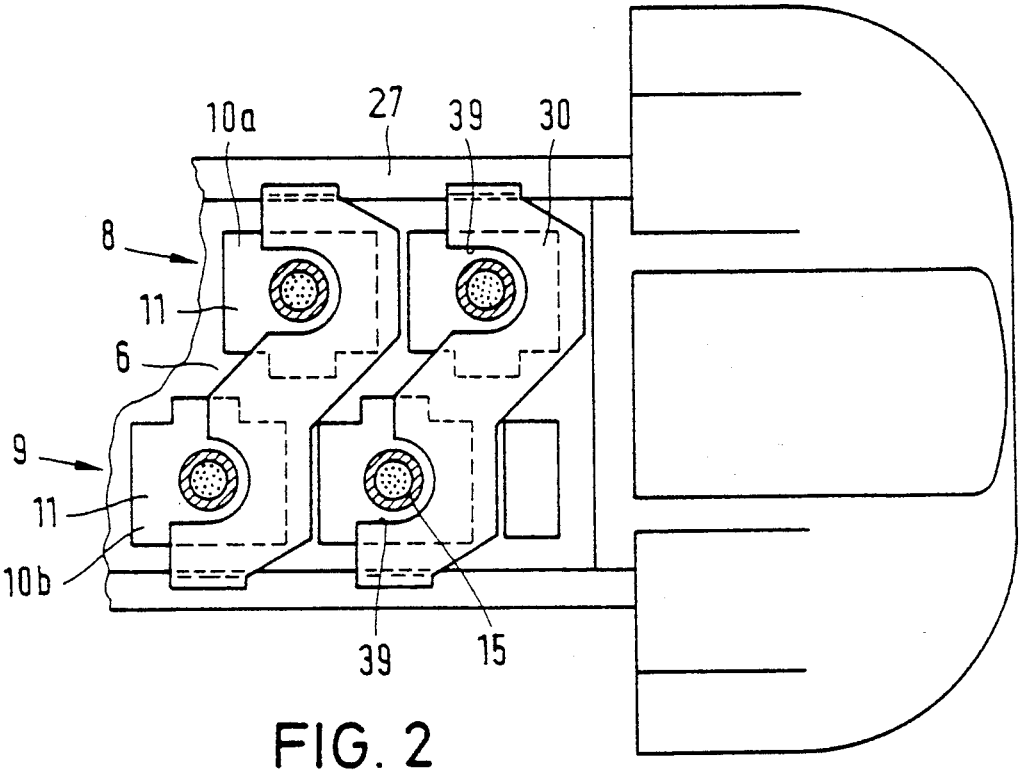
FIG. 2 shows a plan view of a partial portion of the inner casing of the contact sleeve casing according to FIG. 1.

The contact sleeve casing 1 depicted in FIGS. 1 and 2 can be constructed substantially slab-shaped. It consists of a surrounding casing 2 and an inner casing 3.

The inner casing 3 has side walls 4, 5 and two front walls. The front walls are not depicted because they can be formed arbitrarily. Further, the inner casing 3 has a cover wall 6 and a bottom wall 7.

The inner casing 3 is made wide so that in longitudinal direction two contact chamber series 8, 9 are arranged adjacent to one another, which provide chambers 10*a* and 10*b* spaced from one another in longitudinal direction, in which arrangement each chamber 10*a* as viewed in plan view is staggered with respect to the appertaining chamber 10*b* in each case. From this arrangement there results a central longitudinal wall 26 between the contact chamber series 8, 9.

The chambers 10*a*, 10*b* extend continuously from the cover wall 6 to the bottom wall 7 and are formed substantially rectangular in cross section. The chambers 10*a*, 10*b* issue in each case in the cover wall 6 and a plug opening 11 for the plugging of the electric connector 16 and in the bottom wall 7 with a plug opening 12 with a finder funnel 13 for the introduction of contact pins (not represented).

In the chambers 10*a*, 10*b* there are seated electric connectors 16 crimped to lines 15, the contact portions 17 of these connectors are borne in the lower half 18 and their claw portion 19 is positioned the upper half 14 near the plug opening 11. With a rest spring 20 arranged on the contact spring arm base (not recognizable as set forth below) which spring engages behind an edge 21 in a chamber 10*a* or 10*b*, the connectors 16 are fixed in position in the chambers. The edges 21 lie about in the longitudinal middle of the chambers 10*a*, 10*b*, from which the upper half 14 extends upward and the lower half 18 extends downward.

The connectors 16 are equipped with an over-spring, in which arrangement in the direction from the over-spring arm base 22 to the plug opening 12, there point over-spring arms 24 which are supported on the contact spring arms 23 of the connector 16, the over-spring arm base 22 being seated as a unit construction on and covers the contact spring arm base (not recognizable) of the electric connector 16. The claw portion 19 of the connector 16 communicates with the contact spring arm base over a short-circuit contact strip 25, which is arranged offset outward to the longitudinal central axis 26 of the connector 16. With this form of construction the connectors 16 in the series 8 stand in mirror image to the connectors 16 in the series 9, in such a way that the short-circuit contact strips 25 are adjacent to the side walls 5*a* and 4*a*, respectively of the upper half of the inner casing 3. The inner casing 3 is externally likewise dividable into an upper and a lower half, as the side walls 4*a*, 5*a* of the upper half are made thinner than the side walls 4*b*, 5*b* of the lower half, the side walls 4*a*, 5*a* springing back inwardly and forming a step edge 27.

Proceeding upwardly from the step edge 27, slits 28 in the walls 4*a*, 5*a* in the area of the chambers 10*a*, 10*b* extend in the cover wall 6 direction up to about the height of the claw portions 19 of the connectors 16, so that the short-circuit bridge strips 25 are accessible from outside. The purpose of these accesses will be explained further below.

The short-circuit bridge is formed by a short-circuit bridge bow 29, U-shaped in cross section, according to FIGS. 1 and 2 from a sheet metal stamping part. The bow 29 includes a bridge base strip 30 and two spring arm shanks 31, 32 laterally bound to it. The bridge base strip 30 is borne on the cover wall 6 of the inner casing 3, while the spring arm shanks 31, 32 lie outside in the area in each case above a slit 28 expediently on the side walls 4*a*, 5*a*. They are bent inward in V-form in the free lower end portion to the chambers, and pierce with the V-shaped bend 33*a* in each case a slit 28 and with the contact edge 33 formed by the V-shaped bend, with electric contacting effect, press from outside on the short-circuit contact strip 25 of a connector 16, so that in each case a connector 16 of a chamber 10*a* stands in electrical connection with a connector 16 of a chamber 10*b* through the short-circuit bridge bow 29. There, expediently the contact edge 33 of the spring arm shank 31 is arranged at the same height or at the same level as the contact edge 33 of the spring arm shank 32.

In one of the walls 4*b*, 5*b*, for example in the inside of the wall 5*b* there is introduced a recess 34 extending in longitudinal direction of the inner casing 3, beginning at the plug opening 12 and extending up to the step 27 or up to the beginning of the slit 28, in which system in each case the corresponding free shank 35 of the V-shaped bend 33*a* of the short circuit bridge bow 29 is made longer and extends outward over the recess 34. Instead of a recess 34 there can be arranged a corresponding groove in each chamber 10*b*.

Into the recess 34 there extends a separating pusher 36 which is molded to the contact pin casing (not represented). In the event that instead of the recess 34, corresponding grooves are provided in the chambers 10*b*, corresponding separating pins are molded on the contact pin casing.

If the contact pin casing is seated securely on the inner casing 3, then the separating pusher 36 is thrust so far into the inner casing 3 that it suspends the contacting of the spring are shank 32, i.e. the edge 37 presses against the bevel of the free shank 35 and places the spring arm shank 32 at a distance from the appertaining short-circuit contact strip 25.

When the surrounding casing 2 with the inner casing 3 is drawn off from the contact pin casing (not represented) or the latter is drawn off in arrow direction 38 from the inner casing 3, the separating pusher 36 also slides and frees the spring arm shank 32, so that the latter can spring against the short-circuit contact strip 25 and thereby can bring about a short circuit. The spatial forms are adjusted to one another in such a way that the short cirucit is established before the contact between the contact pins (not represented) and the spring arms 23 is interrupted.

Since in the example represented the cooperating connectors to be short circuited are borne diagonally staggered to one another in the chambers 10*a*, 10*b*, the bridge base strip 30 is correspondingly constructed diagonally running (see FIG. 2), the bridge base strip 30 including in each case a semicircular stamping-out 39 in the region over a plug opening 11, which is gripped through by a line 15. Accordingly, the bends 48, 49 of the spring arm shanks 31, 32 lie diagonally opposite.

Expediently on the upper half of the inner casing 3 there is seated a surrounding casing 40 with side walls 41, 42 and cover wall strips 43 extending in longitudinal direction. The side walls 41, 42 grip over the corresponding side walls of the inner casing 3 and are seated on the step edge 27, in which arrangement the cover wall strips 43 in the area of the bends 48, 49 press on the bow base strip 30, so that the short circuit bridge bow 29 is held securely by means of the surrounding casing 40. In the area of the step edge 27 the surrounding casing is equipped with a, for example, surrounding grip strip 44, which facilitates the handling.

The inner surface of the side wall 41 lies closely adjacent to the spring arm shank 31. The inner surface of the side wall 42, in contrast, is offset outward, so that a free space 45 is formed, in which the spring arm shank 32 can swing when the separating pusher 36 is pushed in with the contact pin casing and in which the spring arms 32 can rest when the separating pusher 36 is slid in completely.

Figure 4:
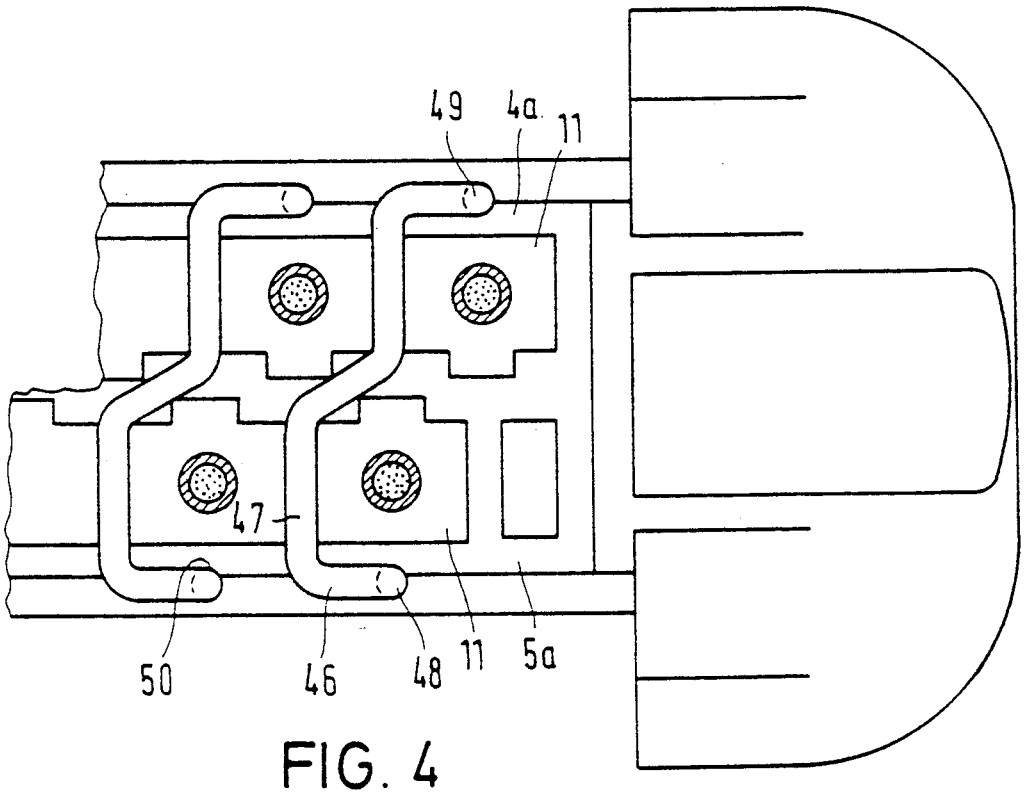
FIG. 4 shows a plan view of a partial portion of the inner casing of the contact sleeve casing according to FIG. 3.
Figure 3:
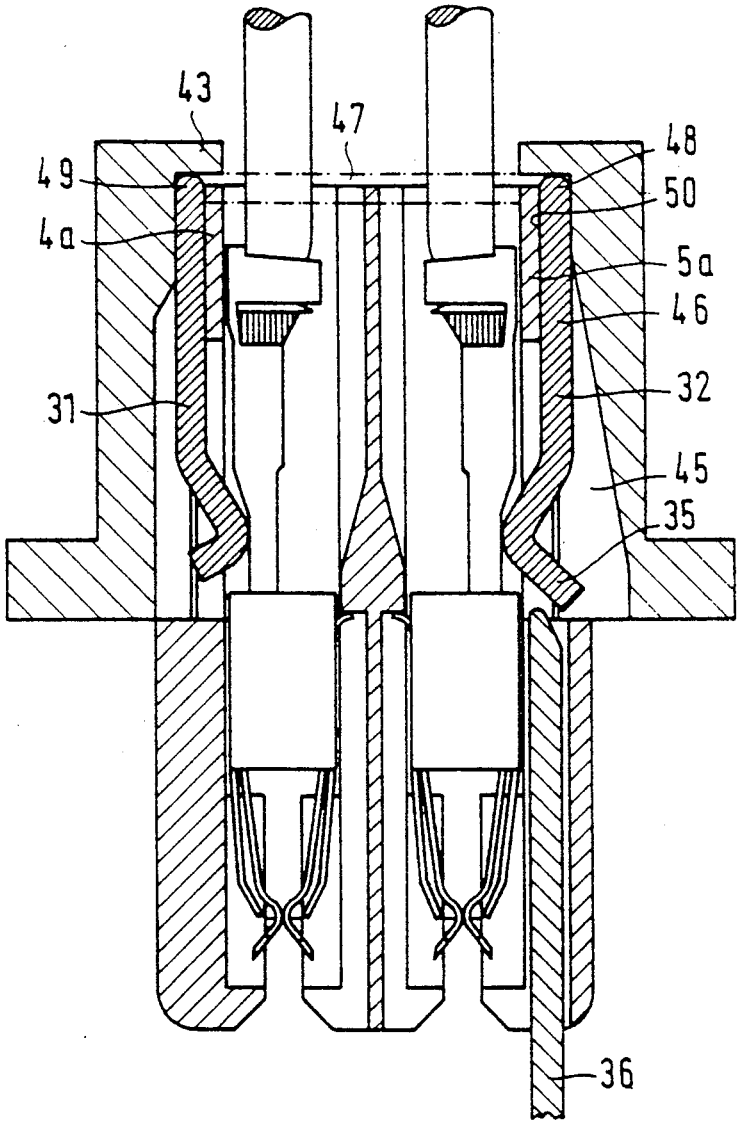
FIG. 3 shows a cross section through another contact sleeve casing.

The short circuit bridge arrangement depicted in FIGS. 3 and 4 resembles the short circuit bridge arrangement represented in FIGS. 1 and 2 except for the spatial form of the short circuit bridge bow. For this reason the individual parts of the short circuit bridge arrangement are not again provided with identification numbers. The short circuit bridge bow according to FIGS. 3 and 4 does not consist of a sheet metal stamped part, but of a spring wire 46, the base strip 47 being curved in such a way that it does not grip over any of the plug openings 11 or in each case is arranged on the border strips between the plug openings 11, and the bends 48, 49 of the spring arm shanks 31, 32, as viewed in plan, (FIG. 4) are arranged diagonally opposite. There it is advantageous if in the side walls 4*a*, 5*a* of the-inner casing 3 there are provided grooves 50 adapted in cross section to the wire form, for example semicircular grooves, for the bearing of the spring arm shanks 31, 32, and if, preferably in addition to the cover wall strips 43 of the surrounding casing 40, the inner surfaces of the side walls 41, 42 of the surrounding casing 40, at least in the upper portion or in the area of the bends 48, 49, press from outside against the spring arm shanks 31, 32, so that the short-circuit bridge bow 29 is borne undisplaceably. Such a bearing can, of course, also be provided correspondingly for the short-circuit bridge bow 29 consisting of a sheet metal stamped part.

Figure 5:
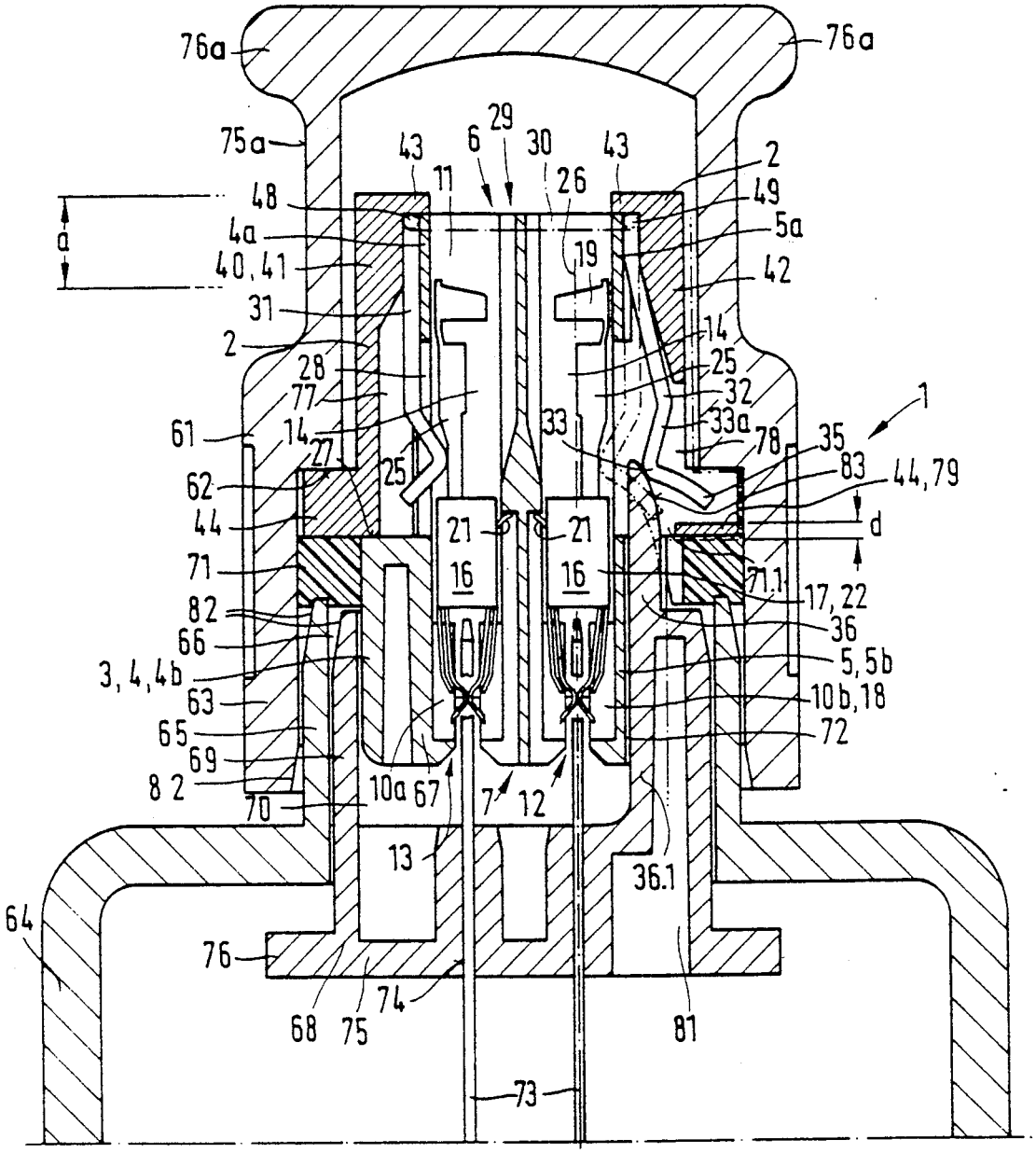
FIG. 5 shows a contact sleeve casing in a modified embodiment.

In the example of execution according to FIG. 5, which functions theoretically in the same manner and in which the same or comparable parts are designated with the same reference numbers, the surrounding casing 2 is received a protective or plug casing 61, in which arrangement it lies with the back of its flange-form strips 44 present preferably on its entire circumference, here serving for its positioning in the plug casing 61, on a step, surface 62 of a cross-section setback in the plug casing 61. The plug casing 61 is pluggable or pluged, with a tubular plug section 63 projecting from the step surface 62, onto a tubular connector piece 65 projecting from a contact pin casing 64, in which system the inner casing 3, with preservation of an annular space 66 between it and the inner wall of the connecting piece 65, and with its inner section 67 surrounding the contact spring arms 23, extends into the connecting piece 65. Into the annular space 66 from the inside of the contact pin casing 64, there is inserted or plugged a pot-shaped contact pin holder 68 with its tubular plug part 69. The plug part 69 extends to in front of a sealing and/or clamping ring 71 which is arranged between the flange-form strip 44 and the free end of the connecting piece 65 and is compressed in the inserted state. The separating pusher 36 extends in one piece from the free edge of the plug part 69, in which arrangement the separating pusher 36 aligns with an inner material added piece 36.1 and is slidably guided in an axial groove 72 of the section 67. Separating pushers 36 can be provided to match in the number of the connector pairs 16.

In the example of execution according to FIG. 5 the contact pins contacting the contact spring arms 23 are represented and designated with 73. The contact pins 73 are led through holes or lead-throughs 74 in the bottom part 75 of the pot-shaped contact pin holder 68 extended on the inside by support lugs. On the outer edge of the bottom part 75 there is provided a flange part 76 which can serve for the support or handling of the contact pin holder 68. The hollow space of the contact pin holder 68 receiving the section 67 of the inner casing 3 is designated with 70.

On the circumference of the plug casing 61 there are provided transversely extending depressions 75*a* on opposite sides and at a distance from the back, whereby there are formed oppositely lying grip strips 76*a* which improve the gripping strength. In the emplacing of the plug casing 61 on the connecting pieces 65 the spring arm shank 32 is bent out by contact with the separating pusher 36. It would also be possible, for the spring arm shank 31 to be bent out, in order to let it lie with prestress on the appertaining, possibly longitudinally profiled short circuit contact strip 25. In order to make this possible, in the inner surfaces of the side walls 41, 42, longitudinally extending recesses 77, 78 are provided which begin at a distance a from the bridge base strip 30, so that the feed of the spring shanks 31, 32 are closely gripped about by the inner surfaces. The recess 77 runs out at the face side of the surrounding casing 2, since it is inside the sealing and/or clamping ring 71. Because of the longer free shank 35 of the spring arm shank 32 the lower dimensioned recess 78 here executed radially continuous in this area runs out, to be sure, also on the face side of the surrounding casing 2 as hole 71.1, so that the separating pusher 36 can be thrust into the recess 78, but there remains in the area of the sealing and/or clamping ring 71 a wall strip 79 with a thickness d, in order to assure the full engagement of the sealing and/or clamping ring 71 on the face side of the surrounding casing 2.

With 81 there is designated a blind hole arranged axially in the contact pin holder 68 in the area of the material lug 36.1 and running out on the inside, which is provided to save material and weight.

For the purpose of facilitating the assembling or putting together of the plug parts, on the introduction edges of the plug casing 61 of the connecting piece 65 and of the plug part 69 there are provided chamferings 82. A comparable chamfering 83 or rounding is also provided on the outer contact edge of the separating pusher 36.

As already in the previously described embodiments according to FIGS. 1 to 4, also in this embodiment the arrangement and/or dimensioning is made in such a way that on opening of the plug by drawing off the plug casing 61 from the connecting piece 65, the surrounding casing and inner casing 2, 3 with the contact spring arms 23 have likewise been drawn off, and, namely, in this path of solution first the contact is released between the separating pusher 36 and the spring arm shank 32, so that first of all the contact closes between the spring arm shank 32 and the short circuit bridge 25 closes, and then the contacts between the contact spring arms 23 and the contact pins 73 are opened.

We claim:

1. An electrical switching arrangement for an electric contacting system of an airbag, comprising:

a short circuit bridge arrangement provided in a plug;

said plug including a counter-contact casing (64) and a contact sleeve casing (1) of plastic, the two casings (1,64) being releasably connected with one another;

at least one of the two casings (1,64) being provided with chambers (10*a*,10*b*), said chambers (10*a*,10*b*) receiving connectors (16,73) therein, said connectors (16,73) being connected to electric lines (15);

said short circuit bridge arrangement including a short circuit bridge (29) provided, in each case, between adjacent contacts of said connectors (16,73);

means associated with said short circuit bridge (29) so that upon opening of said plug, said adjacent contacts are short-circuited first before said connectors (16,73) of said plug are separated from each other; and said contact sleeve casing (1) being constructed substantially in slab form, said contact sleeve casing (1) including a surrounding casing (2) and an inner casing (3).

2. Switching arrangement according to claim 1, characterized in that on a circumference of the inner casing (3) there is arranged an axially parallel groove (72) for a separating pusher (36).

3. Switching arrangement according to claim 2, characterized in that the groove (72) is continued in a zone of a sealing and/or clamping ring (71) as a hole (71.1) in the inner casing (3).

4. Switching arrangement according to claim 1 characterized in that the surrounding casing (2) is arranged in a plug casing (61) and held therein.

5. Switching arrangement according to claim 4, characterized in that the plug casing (61) is pot-shaped, a cross section of an inner or hollow space of the plug casing (61) tapers inward in step form in a middle zone and the surrounding casing (2) lies with at least one flange-form supporting part (44) on a step surface (62).

6. Switching arrangement according to claim 5, characterized in that the supporting part (44) extends over an entire circumference of the surrounding casing (2) and on a side of the supporting part (44) facing away from the step surface (62) there lies a sealing ring and/or radially effective clamping ring (71) of elastic material.

7. Switching arrangement according to claim 4, characterized in that the plug casing (61) is emplaceable on a tubular connecting piece (65) of a contact pin casing (64), in which a contact pin holder (68) with a face-side recess (70) is fixed, into which in a plugging position there is immersed a front end of the inner casing (3).

8. Switching arrangement according to claim 7, characterized in that the contact pin holder (68) is constructed in pot form and contact pins (73) grip through a bottom part (75) of the contact pin holder (68) and are held therein.

9. Switching arrangement according to claim 7, characterized in that the contact pin holder (68) is inserted from inside into the connecting piece (65).

10. Switching arrangement according to claim 7, characterized in that separating pusher (36) is molded to an outer end of the contact pin holder (68).

11. An electrical switching arrangement for an electric contacting system of an airbag, comprising:

a short circuit bridge arrangement provided in a plug;

said plug including a counter-contact casing (64) and a contact sleeve casing (1) of plastic, the two casings (1,64) being releasably connected with one another;

at least one of the two casings (1,64) being provided with chambers (10*a*,10*b*), said chambers (10*a*,10*b*) receiving connectors (16,73) therein, said connectors (16,73) being connected to electric lies (15);

said short circuit bridge arrangement including a short circuit bridge (29) provided, in each case, between adjacent contacts of said connectors (16,73);

means associated with said short circuit bridge (29) so that upon opening of said plug, said adjacent contacts are short-circuited first before said connectors (16,73) of said plug are separated from each other; and said contact sleeve casing (1) including an inner casing (3), said inner casing (3) having side walls (4,5) and two front walls, as well as a cover wall (6) and a bottom wall (7).

12. Switching arrangement according to claim 11, characterized in that the inner casing (3) is of such width that in longitudinal direction two contact chamber series (8, 9) are arranged adjacent to one another, which provide in longitudinal direction chambers (10*a* and 10*b*) spaced from one another, each chamber (10*a*), as viewed in plan, being arranged staggered to in each case the appertaining chamber (10*b*).

13. Switching arrangement according to claim 12, characterized in that the chambers (10*a*, 10*b*) extend continuously from the cover wall (6) to the bottom wall (7) and are formed substantially rectangular in cross section, in which system the chambers (10*a*, 10*b*) in each case issue in the cover wall (6) in a plug opening (11) for the plugging of an electric connector (16) and in the bottom wall (7) with a plug opening (12) with a finding funnel (13) for the introducing of contact pins or similar contact elements.

14. Circuit arrangement according to claim 13, characterized in that in the chambers (10*a*, 10*b*) there are seated electric connectors (16), crimped to lines (15), in a lower half (18) and their claw portions (19) in an upper half (14) lie near the plug opening (11).

15. Switching arrangement according to claim 14, characterized in that a rest spring (20) arranged on a contact spring arm base (22), engages behind an edge (21) in a chamber (10*a* or 10*b*) so that the connectors (16) are fixed in position in the chambers 16. Switching arrangement according to claim 15, characterized in that the edges (21) lie about in the longitudinal center of the chambers (10*a*, 10*b*), from which there extend upward the upper half (14) of the chambers (10*a*, 10*b*) and downward the lower half (18).

17. Switching arrangement according to claim 13, characterized in that the connectors (16) are equipped with an over-spring, in which from its over-spring arm base (22) to the plug opening (12) there point over-spring arms (24), which are supported on the contact spring arms (23) of the connector (16), the over-spring, arm base (22) being seated in closed linkage on a contact spring arm base of the electric connector (16).

18. Switching arrangement according to claim 17, characterized in that a claw zone (19) of the connector (16) is connected with the contact spring arm base over a short circuit contact strip (25) which is arranged offset to the longitudinal center axis (26) of the connector (16) to the outside and that the connectors (16) stand in the series (8) in mirror image to the connectors (16) in the series (9) in such a way that the short circuit contact strips (25) stand adjacent to the side walls (5*a* and 4*a*) of an upper half of the inner casing (3), and that the inner casing (3) is outwardly likewise subdivided into the upper and a lower half, as the side walls (4*a*, 5*a* ) of the upper half are constructed thinner than the side walls (4*a*, 5*b*) of the lower half, the side walls (5*a*, 5*b*) springing back and forming a step edge (27).

19. Switching arrangement according to claim 18, characterized in that proceeding from the step edge (27) slits (28) in the side walls (4*a*, 5*a* ) in a zone of the chambers (10*a*, 10*b*) extend in the direction cover wall (6) to about at the level of the claw portions (19) of the connectors (16), so that the short circuit bridge strips (25) are accessible from outside.

20. Switching arrangement according to claim 11, characterized by the short circuit bridge which includes a short circuit bridge bow (29) U-shaped in cross section, with a bridge base strip (30) and two spring arms shanks (31, 32) laterally attached thereto, in which the bridge base strip (30) is borne on the cover wall (6) of the inner casing (3), while the spring arm shanks (31, 32) lie outside in a zone, in each case, above a slit (28) expediently to the side walls (4*a*, 5*a* ) and contact the short circuit bridge strips (25).

21. Switching arrangement according to claim 20, characterized in that the spring arm shanks (31, 32) in the free lower end zone are bent off in V-shape inward to inner casing chambers, extend with the V-shaped bend (33*a*) in each case through a slit (28) and with a contact edge (33) formed by the V-shape bend press with electric contacting effect from outside on the short circuit contact strip (25) of a connector (16), so that in each case a connector (16) of a chamber (10*a*) is connected with a connector (16) of a chamber (10*b*) electrically through the short circuit bow (29).

22. Switching arrangement according to claim 21, characterized in that the contact edge (33) of one spring arm shank (31) is arranged at the same height or at the same level as the contact edge (33) of the other spring arm shank (32).

23. Switching arrangement according to claim 21, characterized in that in the inside of the wall (5*b*), there is installed a recess (34) extenting in longitudinal direction of the inner casing (3), beginning at a plug opening (12) and going up to a step 27 or to the beginning of the slits (28), in which in each case a corresponding free shank (35) of the V-shaped bend (33*a*) of the short circuit bridge bow (29) is made longer and extends outward beyond the recess (34).

24. Switching arrangement according to claim 23, characterized in that into the recess (34) there extends a separating pusher (36) which is molded on the counter-contact casing, the separating pusher (36) being thrust so far into the inner casing (3) when the counter-contact casing is firmly seated on the inner casing (3) that the separating pusher suspends the contacting of the spring arm shank (32), as an edge (37) presses against a bevel of the free shank (35) and bears the spring arm shank (32) at a distance from the appertaining short circuit contact strip (25).

25. Switching arrangement according to claim 13, characterized in that, in each inner casing chamber (10*b*) there is arranged a corresponding groove.

26. Switching arrangement according to claim 20, characterized in that the interacting short-circuiting connectors (16) are diagonnaly offset to one another in chambers (10*a*, 10*b*) arranged correspondingly diagonally offset to one another and that the bridge base strip (30) is constructed correspondingly diagonally extending.

27. Switching arrangement according to claim 26, characterized in that the bridge base strip in each case has a semicircular stamp-out (39) in the zone over a plug opening (11), which is gripped through by a line (15).

28. Switching arrangement according to claim 20, characterized by a surrounding casing (40) seated on the upper half of the inner casing (3), with side walls (41, 42) and cover wall strips (43) extending in longitudinal direction, in which the side walls (41, 42) grip over the corresponding side walls of the inner casing (3) and are seated on a step edge (27), in which arrangement the cover wall strips (43) in a zone of bends (48, 49) of the spring arm shanks (31, 32) press on the bridge base strip (30), so that the short circuit bridge bow (29) is held fast by means of the surrounding casing (40).

29. Switching arrangement according to claim 28, characterized in that in a zone of the step edge (27) the surrounding casing is equipped with a, surrounding grip strip (44).

30. Switching arrangement according to claim 28, characterized in that an inner surface of the side wall (42) is formed offset outward, so that a free space (45) is formed into which the spring arm shank (32) can swing when, with a contact pin casing, a separating pusher (36) is pushed in and in, which the spring arm shank (32) can rest when the separating pusher (36) is completedly pushed in.

31. Switching arrangement according to claim 20, characterized in that in addition to the cover wall strips (43) of the surrounding casing (40) an inner surfaces of the side walls (41, 42) of the surround casing (40) are pressed at least in an upper region or in a region of the bends (48) from outside against the spring arm shanks (31, 32), so that the short circuit bridge bow (29) is immovably seated.

32. Switching arrangement according to claim 28, characterized in that the inner surfaces of the side walls (41, 42) in a zone of the bridge base strip (30) lie closely adjacent to a spring arm shanks (31, 32) and that in the zone of the spring arm shanks (31, 32) there are arranged recesses (77, 78) in the inner surfaces of the side walls (41, 42), which have a distance (a) from the bridge base strip (30) and into which the spring arm shanks (31, 32) can be bent out.

33. Switching arrangement according to claim 32, characterized in that the recess (78) for the spring arm shanks (32) interacting with a separating pusher (36) is radially widened in a zone of its free end of the spring arm shank (32), extends runs out radially, and that this extension has a distance (d) from an appertaining face side of the surrounding casing (2).

34. Switching arrangement according to claim 20, characterized in that the short circuit bridge bow consists of a sheet metal stamped part.

35. Switching arrangement according to claim 20, characterized in that the short circuit bridge bow is bent from a spring wire.

36. Switching arrangement according to claim 35, characterized in that a base strip (47) of the spring wire (46) is bent in such a way that it avoids any plug openings (11) or is arranged always on border strips between the plug openings (11), bends (48, 49) of the spring arm shanks (31, 32), as viewed in plan, are arranged diagonally opposite each other.

37. Switching arrangement according to claim 36, characterized in that an outer surface of the side walls (*4a*, *5a* ) of the inner casing (3) includes grooves (50) adapted in cross section to the spring wire for the bearing of the spring arm shanks (31, 32).

* * * * *

UNITED STATES PATENT AND TRADEMARK OFFICE

CERTIFICATE OF CORRECTION

PATENT NO. : 5,064,973

DATED : November 12, 1991

INVENTOR(S) : Bernd Zinn and Werner Reuter

It is certified that error appears in the above-identified patent and that said Letters Patent is hereby corrected as shown below:

Column 7, (claim 17) line 39, the "," second occurrence should be cancelled.
Column 8, (claim 25) line 42, claim "13" should read claim --21--.
Column 9, (claim 29) line 1, the "," should be cancelled.
Column 9, (claim 30) line 8, the "," should be cancelled, and a --,-- should be inserted after "in" first occurrence.
Column 9, (claim 31) line 12, claim "20" should read claim --28--; and line 3, "an" should read --,--.
Column 10, (claim 33) line 7, "runs" should be cancelled.
Column 10, (claim 36) line 18, --overlapping-- should be inserted after "avoids".

Signed and Sealed this

Fourth Day of May, 1993

Michael K. Kirk

MICHAEL K. KIRK

*Acting Commissioner of Patents and Trademarks*

*Attest:*

*Attesting Officer*